US005922656A

United States Patent [19]

Yoshimura et al.

[11] Patent Number: 5,922,656

[45] Date of Patent: Jul. 13, 1999

[54] LUBRICANT COMPOSITIONS FOR AUTOMATIC TRANSMISSIONS

[75] Inventors: Narihiko Yoshimura; Takanori Kugimiya, both of Saitama-Ken; Takanori Nakada, Toyota; Fumio Ueda, Aichi-Ken; Yasushi Ando, Toyota, all of Japan

[73] Assignees: Tonen Corporation, Tokyo; Toyota Jidosha Kabushiki Kaisha, Aichi-ken, both of Japan

[21] Appl. No.: 09/046,091

[22] Filed: Mar. 23, 1998

Related U.S. Application Data

[30] Foreign Application Priority Data

Mar. 24, 1997 [JP] Japan ..... 9-088797

[51] Int. Cl.[6] ..... C10H 141/10

[52] U.S. Cl. ..... 508/408; 508/411; 508/413; 508/434; 508/438; 508/518; 508/554; 508/555; 508/572

[58] Field of Search ..... 508/408, 411, 508/413, 434, 438, 518, 554, 555, 572

[56] References Cited

U.S. PATENT DOCUMENTS

| | | | |
|---|---|---|---|
| 4,752,416 | 6/1988 | Scharf et al. | 508/434 |
| 4,800,029 | 1/1989 | Dasai . | |
| 5,064,546 | 11/1991 | Dasai . | |
| 5,328,620 | 7/1994 | Ripple | 508/390 |
| 5,585,030 | 12/1996 | Nibert et al. | 508/434 |
| 5,840,663 | 11/1998 | Nibert et al. | 508/438 |

FOREIGN PATENT DOCUMENTS

| | | |
|---|---|---|
| 0 399 764 B1 | 3/1992 | European Pat. Off. . |
| 63-254196 | 10/1988 | Japan . |
| 5-105892 | 4/1993 | Japan . |
| 8-319494 | 12/1996 | Japan . |

*Primary Examiner*—Jacqueline V. Howard
*Attorney, Agent, or Firm*—Morrison & Foerster, LLP

[57] ABSTRACT

The lubricant composition of the present invention can be used in automatic transmissions and contains 0.05 to 2% of a metallic salt of organic acid (component (A)), such as calcium sulfonate, 0.15 to 4% of a specific polyamide compound (component (B)) and 0.05 to 1.5% of acid phosphate or acid phosphite ester (component (C)) which are added to a lubricant base oil, wherein all percentages are by weight in the total lubricant composition. The lubricant composition for automatic transmissions can show high anti-shudder property, high anti-shudder durability for an extended period, high property of preventing clogging of the friction material, and sufficient transmission torque capacity, while retaining the lubricant characteristic requirements for use in automatic transmissions.

14 Claims, No Drawings

LUBRICANT COMPOSITIONS FOR AUTOMATIC TRANSMISSIONS

BACKGROUND OF THE INVENTION

The present invention relates to lubricant compositions for automatic transmissions. More particularly, for automatic transmissions equipped with a mechanism to control automobile slip, characterized by high transmission torque capacity, and other favorable properties, such as those related to anti-shudder property, anti-shudder durability and prevention of clogging of materials.

A lubricant for an automatic transmission can be used in an automobile equipped with a gear and hydraulic mechanism, wet type clutch, and so on. This type of lubricant required to have a variety of properties, because it functions as the power transmission medium for the torque converter, and hydraulic and control systems, as the lubricant and heating medium for the gears, bearings and wet type clutch, and also as the lubricant medium and the medium to maintain the friction-related characteristics of the friction material. It must perform these functions well for the smooth operation of the automatic transmission.

Recently, lock-up clutches have been built in torque converters in many automobiles to improve mileage. A lock-up clutch is a device that directly transmits the engine driving force to the transmission under varying running conditions. Torque converter efficiency can be enhanced when switching between torque converter driving and direct driving is well timed.

However, a conventional lock-up mechanism works only in a high-speed range and not in a low speed range. This results in power transmission loss (revolutions per minute) between engine output and transmission input, decreasing gas mileage, during the starting period and in other low speed conditions. In an attempt to decrease that power transmission loss, some automobiles have a lock-up mechanism that works at a low automatic transmission speed. In such a case, slip control is adopted to help the lock-up clutch work in the low speed range. However, abnormal vibration of the car body, known as shudder, has been frequently observed at the lock-up clutch's friction surface, when the lock-up mechanism is operated at low speed. Such a phenomenon is more pronounced, when coefficient of friction decreases as relative sliding velocity increases at the slip-controlled lock-up clutch. In order to prevent the shudder phenomenon, the lubricant is required to have good $\mu$ (coefficient of friction)-V (sliding velocity) characteristics. In other words, it is required to have a coefficient of friction which increases as sliding velocity increases.

Esters of phosphates, aliphatic acids and fatty amides have been proposed as friction modifiers for automatic transmission lubricants, as disclosed by Japanese Laid-open Patent application 63-254196. However, these modifiers have disadvantages which result in a decreasing coefficient of friction at the lock-up clutch, and in insufficient transmission torque.

The applicants of the present invention have proposed the use of metallic salts of alkyl phenates and sulfided alkyl phenates (Japanese Patent Laid-open 5-105892), and to simultaneously use an organic metallic salt, such as calcium sulfonates, and a specific polyamide compound (Japanese Laid-open Patent application 8-319494). However, the friction material still clogs even in the presence of the above modifiers, when the lubricant is used for an extended period, which causes degradation of the friction-related properties, such as lowered coefficient of friction of the lock-up clutch and degraded anti-shudder property. Therefore, demands are increasing for an automatic transmission lubricant, which has a high transmission torque capacity, improved anti-shudder property, extended anti-shudder and durability for preventing clogging of the friction material, and development of the related techniques has been in strong demand.

It is an object of the present invention to provide automatic transmission lubricant compositions, which exhibit high anti-shudder durability when the lock-up mechanism is in service at low speed and for automatic transmissions equipped with a slip-controlled mechanism. The lubricant compositions have high durability and work for extended periods without being degraded, are excellent for preventing clogging of material, and provide sufficient transmission torque capacity.

SUMMARY OF THE INVENTION

The applicants of the present invention have extensively studied to meet the above requirements by providing a lubricant composition for automatic transmissions which exhibits high anti-shudder property, high anti-shudder durability for extended periods, high property of preventing clogging of the friction material, and sufficient transmission torque capacity, while retaining the lubricant characteristic requirements for use in automatic transmissions. The lubricant comprises a metallic salt of an organic acid, a specific polyamide compound and at least one acid phosphate ester or acid phosphite ester which are added to the lubricant base oil.

The present invention provides a lubricant composition comprising the following components (A) through (C):

(A) an at least one compound selected from the group consisting of the following general formulae [I] through [VII];

[I]

(1) 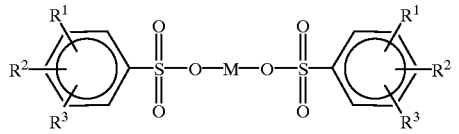

[II]

(2) 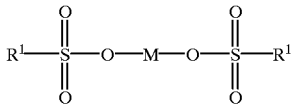

[III]

(3) 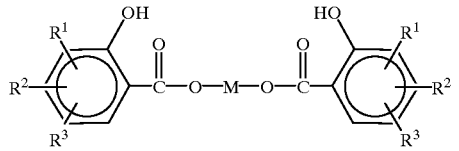

[IV]

(4) 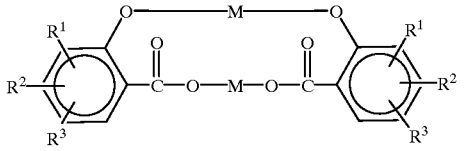

-continued

[V]

(5) 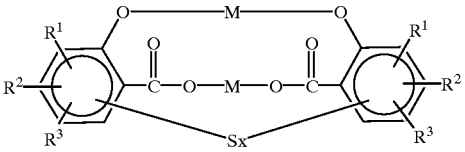

[VI]

(6) 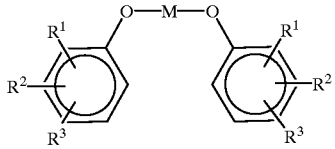 and

[VII]

(7) 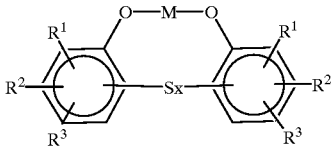

wherein, M is an alkaline-earth metal, $R^1$ is a hydrocarbon group having a carbon number of 6 to 18, and $R^2$ and $R^3$ are independently hydrogen or a hydrocarbon group having a carbon number of 1 to 18, which may be the same or different from each other, in the general formulae [I] through [VII], and x is an integer of 1 to 5 in the general formulae [V] and [VII], (B) a polyamide compound represented by the following general formula [VIII],

[VIII]

(8) 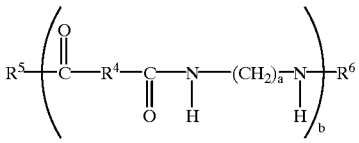

wherein, $R^4$ is a hydrocarbon group having a carbon number of 12 to 50, $R^5$ is OH group or $H_2N(CH_2)_cNH$ group, $R^6$ is hydrogen or a HOOC-$R^7$-CO group, a is an integer of 2 to 6, b is an integer of 1 to 10, c in the above formula $H_2N(CH_2)_cNH$ is an integer of 2 to 6, and $R^7$ in the formula HOOC-$R^7$-CO is a hydrocarbon group having a carbon number of 12 to 50, and (C) at least one compound selected from the group consisting of acid phosphate esters and acid phosphite esters, concentrations of these components on the total lubricant composition being (A) 0.05 to 2%, (B) 0.15 to 4% and (C) 0.05 to 1.5%, all by weight.

DESCRIPTION OF THE PREFERRED EMBODIMENTS

The present invention provides lubricant compositions for automatic transmissions. Preferred embodiments (1) through (7) are described below:

(1) A lubricant composition comprising the following components (A) through (C):

(A) 0.05 to 2% of at least one compound selected from the group consisting of the metallic salts of organic acids represented by the foregoing general formulae [I] through [VII], ($B^1$) 0.15 to 4% of a polyamide compound represented by the following general formula [IX]:

[IX]

(9) 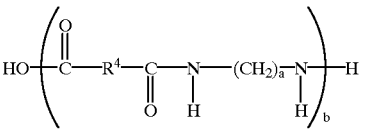

wherein, $R^4$ is a hydrocarbon group having a carbon number of 12 to 50, a is an integer of 2 to 6 and b is an integer of I to 10, and (C) 0.05 to 1.5% of at least one compound selected from the group consisting of acid phosphate esters and acid phosphite esters, all percentages above being by weight on the total lubricant composition.

(2) A lubricant composition comprising the following components (A) through (C):

(A) 0.05 to 2% of at least one compound selected from the group consisting of the metallic salts of organic acids represented by the foregoing general formulae [I] through [VII], ($B^2$) 0.15 to 4% of a polyamide compound represented by the following general formula [X]:

[X]

(10) 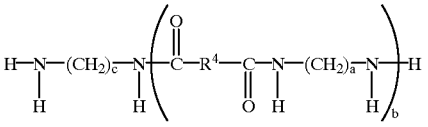

wherein, $R^4$ is a hydrocarbon group having a carbon number of 12 to 50, a is an integer of 2 to 6 and b is an integer of I to 10, and (C) 0.05 to 1.5% of at least one compound selected from the group consisting of acid phosphate esters and acid phosphite esters, all percentages above being by weight on the total lubricant composition.

(3) A lubricant composition of the preferred embodiment (1) or (2), wherein $R^1$ is an alkyl or alkenyl group having a carbon number of 6 to 18, and $R^2$ and $R^3$ are independently hydrogen, or an alkyl or alkenyl group having a carbon number of 1 to 5, which may be the same or different from each other.

(4) A lubricant composition of the preferred embodiment (1), (2) or (3), wherein the ($C^1$) component is an acid phosphate ester.

(5) A lubricant composition of the preferred embodiment (1), (2) or (3), wherein the ($C^2$) component is an acid phosphite ester.

(6) A lubricant composition of the preferred embodiment (1), (2) or (3), wherein the ($C^3$) component is a mixture of acid phosphate ester and acid phosphite ester.

(7) A lubricant composition comprising the foregoing components (A), (B) and (C), which further contains at least one additive selected from the group consisting of a viscosity index improver, a pour depressant, an ashless dispersant, an oxidation inhibitor, an extreme pressure additive, a metal deactivator, a corrosion inhibitor, and an anti-foaming agent.

The present invention is described below in more detail:

(1) Lubricant Base Oil

The lubricant base oil to which the lubricant composition of the present invention is added is not limited, and can be selected from those generally used as lubricant base oils. These oils may be mineral oils, synthetic oils or mixtures thereof.

The mineral oils useful with the present invention include solvent-treated raffinates which are lubricant feedstocks derived from an atmospheric or vacuum pipestill which are treated by aromatic extraction solvents, such as phenol, furfural and N-methyl pyrolidone; hydrotreated oils which are lubricant feedstocks treated with hydrogen over a hydrotreatment catalyst under hydrotreatment conditions; isomerized oils which are waxy oils treated with hydrogen over an isomerization catalyst under isomerization conditions; and lubricant fractions which are produced by a combination of solvent refining, hydrotreatment and isomerization processes. Dewaxing, hydrofinishing and clay treatment can be optionally used under typical conditions. Other examples of mineral oils useful for the present invention include light neutral oils, intermediate neutral oils, heavy neutral oils and bright stocks. They can be mixed with each other in such a way to meet a variety of properties.

The synthetic oils useful for the present invention include poly-α-olefins, α-olefin oligomers, polybutene, alkyl benzenes, polyol esters, dibasic acid esters, polyoxyalkylene glycols, polyoxyalkylene glycol ethers, and silicone oils.

These base oils can be used alone or in combination. For example, the base oil for the present invention can be a mixture of mineral and synthetic oils. The base oil for the present invention has a kinematic viscosity generally in a range from 2 to 20 $mm^2/s$ at 100° C., more preferably in a range from 3 to 15 $mm^2/s$. Excessively high kinematic viscosity of the lubricant base oil may cause problems, such as inadequate viscosity level at low temperature. Excessively low viscosity may cause other problems, such as increased wear at the sliding parts, including those for gear bearings in the automatic transmissions and for clutches.

(2) Component (A)

The compounds represented by the general formulae [I] through [VII] are metallic salts of organic acids, wherein M is an alkaline-earth metal. Preferred alkaline-earth metals are calcium, magnesium and barium, and more preferably calcium. $R^1$ represents the essential hydrocarbon group of relatively long chain in each compound, selected independently from the group consisting of the hydrocarbon groups having a carbon number of 6 to 18. Examples include a straight-chain or branched alkyl group having a carbon number of 6 to 18, a straight-chain or branched alkenyl group having a carbon number of 6 to 18, a cycloalkyl group having a carbon number of 6 to 18, and an aryl group having a carbon number of 6 to 18. The aryl group can have a substituted alkyl group having a carbon number of 1 to 12 or an alkenyl group having a carbon number of 2 to 12. The preferable hydrocarbon group is a straight-chain or branched alkyl group having a carbon number of 6 to 18, more preferably 8 to 12 viewed from transmission torque capacity. $R^2$ and $R^3$ are independently hydrogen or a hydrocarbon group having a carbon number of 1 to 18, which may be the same or different from each other. The hydrocarbon group examples include a straight-chain or branched alkyl group having a carbon number of I to 18, a straight-chain or branched alkenyl group having a carbon number of 2 to 18, a cycloalkyl group having a carbon number of 6 to 30, and an aryl group having a carbon number of 6 to 18. The aryl group can have a substituted alkyl group having a carbon number of 1 to 12 or an alkenyl group having a carbon number of 2 to 12. $R^2$ and $R^3$ are preferably hydrogen. The hydrocarbon group, when used, is preferably a straight-chain or branched alkyl group, and the one having a carbon number of 5 or less works effectively. It is important for the hydrocarbon group represented by $R^1$ to have a carbon number in the specified range, in order to satisfy the requirements for use in automatic transmissions; the one having a carbon number below 6 may show insufficient anti-shudder property, whereas the one having a carbon number above 18 may have insufficient transmission torque capacity.

Next, characteristics of each component represented by the general formulae [I] through [VII] are described below:

The metallic salt of an organic acid, represented by the general formula [I], typically includes metallic salts of alkyl benzenesulfonate. The alkyl benzenesulfonate useful for the present invention to simultaneously satisfy the requirements of anti-shudder property and transmission torque capacity has a straight-chain or branched alkyl group having a carbon number of 6 to 18. The examples include calcium hexyl benzenesulfonate with hexyl group as $R^1$ and hydrogen atom as $R^2$ and $R^3$ in the general formula [I]; calcium octadecyl benzenesulfonate with octadecyl group as $R^1$ and hydrogen atom as $R^2$ and $R^3$; magnesium dodecyl benzenesulfonate; and barium dodecyl benzenesulfonate. The other examples useful for the present invention include calcium hexadecyl toluenesulfonate with hexadecyl group as $R^1$, methyl group as R and hydrogen atom as $R^3$; and calcium hexadecyl xylenesulfonate with hexadecyl group as $R^1$ and methyl group as $R^2$ and $R^3$. The metallic salt of the organic acid used in the present invention may be normal, basic or overbased.

The metallic salt of an organic acid, represented by the general formula [II], includes metallic salts of alkyl sulfonate. $R^1$ in the general formula [II] is the same as that in the general formula [I] in type and chain length. The alkyl sulfonate useful for the present invention has a straight-chain or branched alkyl group having a carbon number of 6 to 18. The metallic salt of alkyl sulfonate may be normal, basic or overbased.

The metallic salt of an organic acid, represented by the general formulae [III], [IV] and [V], includes metallic salts of salicylate having a hydrocarbon group. The preferable hydrocarbon group is an alkyl group having a carbon number of 6 to 18, more preferably 10 to 14. The preferable metallic salt of salicylate is calcium salt, such as calcium dodecyl salicylate. The metallic salicylate may be normal, basic or overbased, and the one represented by the general formulae [IV] and [V] is preferably an overbased one in which $M(OH)_2$ or $MCO_3$ is dispersed colloidally.

The preferable metallic salt of an organic acid, represented by the general formulae [VI] and [VII], includes metallic salts of alkyl phenol, and the preferable one represented by the general formula [VII] is a metallic salt of sulfided alkyl phenol, wherein x is an integer of 1 to 5. Increasing the x level beyond 5 may degrade resistance to copper strip corrosion. Calcium salt of dodecyl phenol is cited as an example of the metallic salt of alkyl phenol. The metallic salt of alkyl phenol or sulfided alkyl phenol may be a normal or basic salt.

The above metallic salt of an organic acid as the component (A) is added to a lubricant base oil to a concentration in a range from 0.05 to 2%, preferably from 0.05 to 1.0% by weight of the total composition. The composition containing the component (A) at below 0.05% by weight may exhibit insufficient anti-shudder property whereas above 2% by weight may exhibit insufficient oxidation stability and may lack the ability to prevent clogging of the friction material.

(3) Component (B)

The component (B) of the present invention is the polyamide compound represented by the general formula [VIII]:

[VIII]

(8) 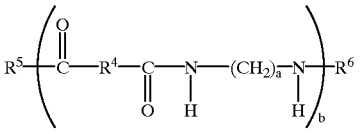

It has a polar group and a long chain hydrocarbon group which is particularly useful as a component for a lubricant composition for automatic transmissions.

In the general formula [VIII], $R^4$ is a hydrocarbon group having a carbon number of 12 to 50, $R^5$ is OH group or $H_2N(CH_2)_cNH$ group, $R^6$ is hydrogen atom or HOOC-$R^7$-CO group, a is an integer of 2 to 6, preferably 2 to 4, and b is an integer of 1 to 10, preferably 2 to 6.

In the general formula [VIII], c in the group $H_2N(CH_2)_cNH$ is an integer of 2 to 6, preferably 2 to 4, and $R^7$ in the formula HOOC-$R^7$-CO is a hydrocarbon group having a carbon number of 12 to 50.

The above hydrocarbon group represented by $R^4$ or $R^7$ includes alkyl, alkylene and alicyclic hydrocarbon groups. The examples include an alkyl group having a carbon number of 12 to 50; an alkylene group having a carbon number of 12 to 50; and an alicyclic hydrocarbon group having a carbon number of 12 to 50. An aryl group having a carbon number of 12 to 50 is another example of the hydrocarbon group, and may be substituted by an alkyl or alkylene group. The main chain between the functional groups is preferably an alkylene chain, such as a methylene chain. The hydrocarbon group having a carbon number below 12 may give the lubricant composition of insufficient durability for practical use, because of greatly degraded anti-shudder property which possibly occurs when it is used for an extended period.

The polyamide compound represented by the general formula [VIII] can be represented by the general formula [IX] or [X], when $R^5$ is an OH group or a $H_2N(CH_2)_cNH$ group and $R^6$ is hydrogen:

[IX]

(9) 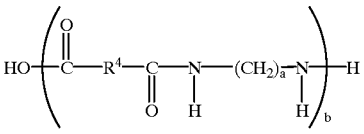

[X]

(10) 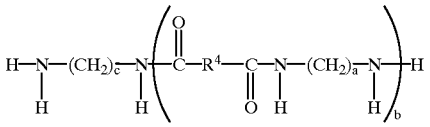

The examples of the compound represented by the general formula [IX] include the polyamide compounds (hereinafter referred to as [Polyamide A1, as necessary] represented by the general formula [XI]:

[XI]

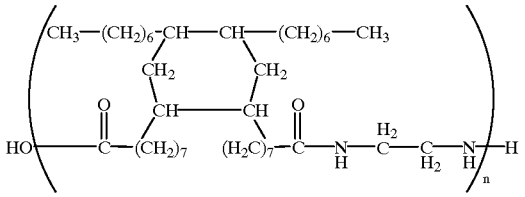

wherein, n is an integer of 2 to 5, and those represented by the general formula [X] include the polyamide compounds (hereinafter referred to as [Polyamide A2, as necessary] represented by the general formula [XII]:

[XII]

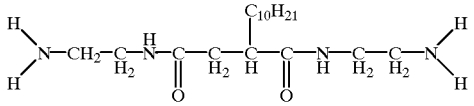

The polyamide compound useful for the present invention is prepared by polymerization/condensation of a dibasic acid or its derivative and diamine or its derivative.

Examples of the dibasic acid and its derivatives include dodecanedioic acid, oleic acid dimer, 2-oleyl succinate and 2-octadecenyl succinate. Examples of the diamine and its derivative include ethylene diamine, trimethyl diamine, tetramethyl diamine, pentamethyl diamine and hexamethyl diamine. 1,7-diaminoheptane and 1,8-diaminooctane are the other examples. An aromatic diamine, such as o-phenylene diamine, m- phenylene diamine and p- phenylene diamine, may be used as the substitute for aliphatic diamine.

The component (B) can be added to a lubricant base oil to a concentration in a range from 0.15 to 4%, preferably from 0.3 to 3%, more preferably from 0.3 to 1.5% by weight of the total composition. The composition containing the component (B) at below 0. 15% by weight may exhibit insufficient anti-shudder property including anti-shudder durability, whereas above 4% by weight insufficient transmission torque capacity may be exhibited.

(4) Component (C)

The component (C) of the present invention is at least one compound selected from the group consisting of acid phosphate esters and acid phosphite esters. Examples of the compound include those represented by the general formula [XIII] or [XIV]:

[XIII]

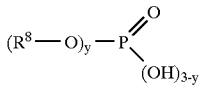

[XIV]

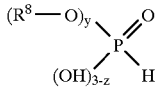

wherein, $R^8$ in the above formulae is a hydrocarbon group having a carbon number of 1 to 24, with that of the general formula [XIII] being the same as, or different from that in the general formula [XIV], and each of y and z is an integer of 1 or 2. The preferable hydrocarbon group has a carbon number of 4 to 18, and the more preferable one is the straight-chain or branched alkyl group having a carbon number of 4 to 18.

Examples of the acid phosphate esters include methyl acid phosphate, ethyl acid phosphate, isopropyl acid phosphate, n-butyl acid phosphate, 2-ethylhexyl acid phosphate, di-2-ethylhexyl acid phosphate, isodecyl acid phosphate, lauryl acid phosphate, tridecyl acid phosphate, stearyl acid phosphate and oleyl acid phosphate.

Examples of the acid phosphite esters include di-2-ethylhexyl hydrogen phosphite, dilauryl hydrogen phosphite, diphenyl hydrogen phosphite and dioleyl hydrogen phosphite. The component (C) is one type of phosphate ester compounds known for their effects and functions for friction adjustment and inhibition. The specific structure gives a quite unexpected effect of improving property of preventing clogging of friction, when added together with components (A) and (B). Its concentration is in a range from 0.05 to 1.5%, preferably from 0.05 to 1% by weight of the total lubricant composition. The composition containing the component (C) at below 0.05% by weight may exhibit insufficient property of preventing clogging of the friction material and its durability, whereas above 1.5% by weight it may exhibit insufficient anti-shudder property, including anti-shudder durability.

The lubricant composition of the present invention contains all of the above components (A), (B) and (C), and is used as a lubricant for automatic transmissions, high transmission torque capacity, initial anti-shudder property, anti-shudder for an extended period, and property of preventing clogging of the friction material, particularly characterized by its high anti-shudder property for automatic transmissions equipped with a slip-controlled mechanism.

(5) Other Additives

The lubricant composition of the present invention for automatic transmissions may be used, with one or more additives, such as a viscosity index improver, an ashless dispersant, an oxidation inhibitor, an extreme pressure additive, a metal deactivator, a pour depressant, an anti-foaming agent, a corrosion inhibitor, and others as long as they do not damage the objective of the present invention.

Examples of the viscosity index improver include polymethacrylate, polyisobutylene, ethylene-propylene copolymer, and styrene-butadiene hydrogenated copolymer types. It is normally added to a concentration in a range from 3 to 35% by weight.

Examples of the ashless dispersant include polybutenyl succinimide, polybutenyl succinamide, benzyl amine and succinate ester types. It is normally added to a concentration in a range from 0.05 to 7% by weight.

Examples of the oxidation inhibitor include amine type such as alkylated diphenyl amine, phenyl-α-naphthylamine and alkylated α-naphthylamine; phenol type such as 2,6-ditertiary butyl phenol and 4,4-methylenebis-(2,6- ditertiary butyl phenol); and zinc dithiophosphate. It is normally added to a concentration in a range from 0.05 to 5% by weight.

Examples of the extreme pressure agent include dibenzyl sulfide, dibutyl disulfide and zinc dithiophosphate. It is normally added to a concentration in a range from 0.05 to 3% by weight.

Examples of the metal deactivator include benzotriazole and thiadiazole derivatives. It is normally added to a concentration in a range from 0.01 to 3% by weight.

Examples of the pour depressant include copolymer of ethylene and vinyl acetate, condensate of chlorinated paraffin and naphthalene, condensate of chlorinated paraffin and phenol, polymethacrylate and polyalkyl styrene. It is normally added to a concentration in a range from 0.1 to 10% by weight.

The lubricant composition of the present invention for automatic transmissions may be added with other types of additives, such as corrosion inhibitors and anti-foaming agents.

The preferable concentrations of the above additives are summarized below:

| | Preferable concentration (% by weight) |
|---|---|
| Viscosity index improver | 4 to 30 |
| Ashless dispersant | 0.1 to 5 |
| Oxidation inhibitor | 0.1 to 3 |
| Extreme pressure additive | 0.1 to 2 |
| Metal deactivator | 0.01 to 2 |
| Pour depressant | 0.5 to 8 |
| Corrosion inhibitor | 0.01 to 5 |
| Anti-foaming agent | 0.0001 to 1 |

The present invention is described in more detail by the examples and comparative examples, which by no means limit the present invention. Transmission torque capacity, initial anti-shudder property, anti-shudder durability, and property of preventing clogging of the friction material, which are used in the examples, were determined by the following methods:

(1) Transmission torque capacity

Dynamic and static friction tests were conducted under the following conditions using an SAE No.2 friction tester.

| Test conditions | |
|---|---|
| Friction material: | SD-1777, 3 specimens |
| Oil quantity: | 800 cc |
| Oil temperature: | 100° C. |
| Pressure on the surface: | 8 kgf/cm$^2$ |

[Dynamic friction test]

The specimen of friction material is rotated at 3,600 rpm and 3.5 kgf cm s$^2$ under no load, while being pressed by two steel plates in which the specimen is placed, and rotation is stopped.

[Static friction test]

The specimen of friction material is rotated at 0.72 rpm, while being pressed by two steel plates in which the specimen is placed, to read a generated rotational torque, from which friction coefficient is determined. Static friction coefficient $\mu$s at the maximum torque, recorded when the specimen starts to slide at the low speed of rotation, is measured.

Transmission torque capacity is assessed by static friction coefficient $\mu$s determined by an SAE No.2 friction tester. A lubricant is considered to have a higher transmission torque capacity as static friction coefficient $\mu$s of the specimen increases beyond 100.

(2) Initial anti-shudder property

Friction coefficients $\mu_H$ and $\mu_L$ are measured with a new oil under the following conditions, using a low velocity friction apparatus (LVFA), to determine $\mu_H$H/$\mu_L$ ratio:

| Test conditions | |
|---|---|
| Friction material: | SD-1777 |
| Oil quantity: | 100 cc |
| Oil temperature: | 80° C. |
| Pressure on the surface: | 10 kgf/cm$^2$ |
| $\mu_H$ | Friction coefficient at a relative sliding velocity of 1.0 m/s |
| $\mu_L$ | Friction coefficient at a relative sliding velocity of 0.5 m/s |

Assessment method $\mu_H/\mu_L$ ratio is used as an index of anti-shudder property, which serves as the standard, based on which anti-shudder effect of the lubricant is judged. It has been confirmed that no shudder will occur in a commercial machine, when $\mu_H/\mu_L$ ratio is higher than 1. Therefore, it is considered that a lubricant has a good anti-shudder property when its anti-shudder index exceeds 1.

(3) Anti-shudder durability

The durability test was conducted for 5,000 cycles under the following conditions, using an SAE No.2 friction tester.

| Test conditions | |
|---|---|
| Friction material: | SD-1777, 3 specimens |
| Oil quantity: | 800 cc |
| Oil temperature: | 120° C. |
| Pressure on the surface: | 8 kgf/cm$^2$ |

The tested oil, which was degraded under forced conditions, was again tested under the above test conditions (2) using an LVFA to determine $\mu_H$ and $\mu_L$. Its durability was assessed by anti-shudder index ($\mu_H/\mu_L$ ratio). A lubricant is considered to have a good anti-shudder property, when its anti-shudder index exceeds 1.

(4) Property of preventing clogging of the friction material

Property of preventing clogging of the friction material was assessed by the following method. The durability test was conducted for 10,000 cycles under the following conditions, using an SAE No.2 friction tester:

| Test conditions | |
|---|---|
| Friction material: | SD-1777, 3 specimens |
| Oil quantity: | 800 cc |
| Oil temperature: | 100° C. |
| Pressure on the surface: | 8 kgf/cm$^2$ |

The durability-tested specimen was placed in heptane for 30 min, degreased, and dried at room temperature in a desiccator. The new oil (4 $\mu$L) was dropped onto the friction material specimen thus pre-treated, using a microsyringe, to determine time required for the oil to completely penetrate into the friction material (penetration seconds) by visual observation. The oil drop test was conducted for a total of four points on the friction material specimen, and averaged time (penetration seconds) is used as an index of property of preventing clogging of the friction material. The material will cause less clogging as its penetration second level decreases, and a lubricant is considered to have a good property of preventing clogging of the friction material, when penetration second level is below 200.

EXAMPLE 1

A solvent-refined paraffinic mineral oil (kinematic viscosity: 4mm$^2$/s at 100° C.) as the lubricant base oil was added with 0. 1% of calcium sulfonate as the component (A), 0.3% of Polyamide A2 as the component (B), 0.3% of 2-ethylhexyl acid phosphate (acid phosphate ester) as the component (C), 5.0% of polymethyacrylate as the viscosity index improver, 4.0% polybutenyl succinimide as the ashless dispersant, 0.3% of alkylated diphenyl amine as the oxidation inhibitor, 0.3% of 2,6-ditertiary butyl phenol as the oxidation inhibitor, and 0.05% of benzotriazole as the metal deactivator, to prepare the lubricant composition for automatic transmissions, where all percentages above are by weight on the total lubricant composition. The lubricant composition thus prepared was tested for its transmission torque capacity, anti-shudder property of the new and tested oil, and property of preventing clogging of the friction material. The results are given below:

| | |
|---|---|
| Transmission torque capacity (static friction coefficient ms at 100th cycle, determined using an SAE No. 2 friction tester) | 0.131 |
| Anti-shudder index with new oil ($\mu_H/\mu_L$) | 1.04 |
| Anti-shudder index with tested oil ($\mu_H/\mu_L$) | 1.02 |
| Property of preventing clogging of the friction material (oil penetration seconds) | 63 |

EXAMPLE 2

The same procedure as used for EXAMPLE 1, except a synthetic oil of α-olefin oligomer (supplied by Mobil Sekiyu, kinematic viscosity: 4mm$^2$/s at 100° C.) was used in place of the solvent-refined paraffinic mineral oil, was repeated to prepare the lubricant composition for automatic transmissions. The lubricant composition thus prepared was tested for its transmission torque capacity, anti-shudder property of the new and tested oil, and property of preventing clogging of the friction material. The results are given in Table 1. The lubricant compositions prepared by EXAMPLE 1 and EXAMPLE 2 show essentially the same results.

EXAMPLES 3 THROUGH 25

The lubricant oil base components, shown in Tables 1 and 2, were added with given concentrations of the additives, also shown in these tables, to prepare the lubricant compositions for automatic transmissions. Each of the lubricant compositions thus prepared was tested for its transmission torque capacity, anti-shudder property of the new and tested oil, and property of preventing clogging of the friction material. The results are given in Tables 1 and 2.

COMPARATIVE EXAMPLES 1 THROUGH 13

The lubricant oil base components, shown in Table 3, were added with given concentrations of the additives, also shown in Table 3, to prepare the lubricant compositions for automatic transmissions. Each of the lubricant compositions thus prepared was tested for its transmission torque capacity, anti-shudder property of the new and tested oil, and property of preventing clogging of the friction material. The results are given in Tables 3.

The following development targets were set in the examples of the present invention for the lubricant compositions for automatic transmissions: transmission torque capacity: above 0.100, in particular above 0.110 or further above 0.120 as static friction coefficient $\mu_s$, anti-shudder property with the new and tested oil: above 1.00 as anti-shudder index ($\mu_H/\mu_L$), and property of preventing clogging of the friction material: below 200 as oil penetration seconds of the friction material tested by an SAE No.2 friction tester for 10,000 cycles.

It is found, as demonstrated by the examples of the present invention, that the high-quality lubricant compositions for automatic transmissions can be prepared when a specified base oil is added with given quantities of an alkaline earth metallic salt of organic acid, such as calcium sulfonate and salicylate, as the component (A), a polyamide compound as the component (B) and an acid phosphate or phosphite ester as the component (C), because the lubricant composition prepared by each example shows a transmission torque capacity (static friction coefficient $\mu_s$) of above 0.100, a anti-shudder index ($\mu_H/\mu_L$) of above 1.00 with the new and tested oil, where essentially no difference is observed between the indices with the new and tested oil, and an oil penetration time, representing property of preventing clogging of the friction material, of below 200 seconds. Taking as an example the lubricant composition prepared by EXAMPLE 1, it is apparent that the lubricant composition has excellent properties for all of the test items; it has a transmission torque capacity of 0. 130, above 0.100 and particularly above 0. 120, showing an excellent power transmission property, a anti-shudder index of 1.04 with the new oil and of 1.02 with the tested oil, which are essentially the same, showing an excellent anti-shudder property and anti-shudder durability, and an oil penetration time of 69 seconds, showing an excellent property of preventing clogging of the friction material.

COMPARATIVE EXAMPLES 1, 4 and 7 prepared the lubricant compositions, in which one of the components (A), (B) and (C) was not used. These compositions cannot satisfy all of the development targets of transmission torque capacity (static friction coefficient $\mu_s$), anti-shudder index ($\mu_H/\mu_L$) with the new and durability-tested oil, and oil penetration time with the friction material. For example, the lubricant composition prepared by COMPARATIVE EXAMPLE 1, which lacks the component (C), shows an unsatisfactory oil penetration time of 322 seconds, although almost meeting the development targets with respect to transmission torque capacity and anti-shudder indices with the new and tested oil, indicating that it has a poor property of preventing clogging of the friction material. Similarly, the composition prepared by COMPARATIVE EXAMPLE 4, which lacks the component (A), shows an unsatisfactory anti-shudder index of 0.97 with the new oil, indicating that it has a poor initial anti-shudder property. The lubricant composition prepared by COMPARATIVE EXAMPLE 7, which lacks the component (B), shows that its initial anti-shudder property and anti-shudder durability are poor. These results clearly indicate that the lubricant composition lacking one of the components (A), (B) and (C) is not of high quality for use for automatic transmissions. The compositions prepared by COMPARATIVE EXAMPLES 10 through 13, although containing the components (A) and (B), use a phosphate ester, tertiary phosphite ester or zinc thiophosphate, as phosphorus-base additives not falling into the category of component (C), in place of the component (C). They show poor property of preventing clogging of the friction material and anti-shudder, because of their unsatisfactory anti-shudder indices with the durability-tested oils. The lubricant compositions prepared by COMPARATIVE EXAMPLES 2, 3, 5, 6, 8 and 9 contain all of the component (A), (B) and (C), but one of their concentrations is outside of the specified range. They cannot satisfy all of the development targets of transmission torque capacity (static friction coefficient $\mu_s$), anti-shudder index ($\mu_H/\mu_L$) with the new and durability-tested oil, and oil penetration time with the friction material. For example, the lubricant composition prepared by COMPARATIVE EXAMPLE 2, which contains the component (C) at 0.03% by weight, below the lower limit specified, cannot satisfy the desired property with respect to prevention of clogging of the friction material, although containing all of the components (A), (B) and (C).

TABLE 1

| | | EXAMPLES | | | | | | | | | | | | |
|---|---|---|---|---|---|---|---|---|---|---|---|---|---|---|
| | | 1 | 2 | 3 | 4 | 5 | 6 | 7 | 8 | 9 | 10 | 11 | 12 | 13 |
| Base oil | Solvent-refined paraffinic mineral oil, | 89.65 | | 89.65 | 89.65 | 89.65 | 89.65 | 89.65 | 89.65 | 89.65 | 89.65 | 89.90 | 88.95 | 89.65 |
| | Synthetic oil | | 89.65 | | | | | | | | | | | |
| Viscosity index improver | Polymethacrylate | 5.0 | 5.0 | 5.0 | 5.0 | 5.0 | 5.0 | 5.0 | 5.0 | 5.0 | 5.0 | 5.0 | 5.0 | 5.0 |
| Ashless dispersant | Succinimide | 4.0 | 4.0 | 4.0 | 4.0 | 4.0 | 4.0 | 4.0 | 4.0 | 4.0 | 4.0 | 4.0 | 4.0 | 4.0 |
| Oxidation inhibitor | Alkylated diphenyl amine | 0.3 | 0.3 | 0.3 | 0.3 | 0.3 | 0.3 | 0.3 | 0.3 | 0.3 | 0.3 | 0.3 | 0.3 | 0.3 |
| | 2,6-ditertiary butyl phenol | 0.3 | 0.3 | 0.3 | 0.3 | 0.3 | 0.3 | 0.3 | 0.3 | 0.3 | 0.3 | 0.3 | 0.3 | 0.3 |
| Metal deactivator | Benzotriazole, | 0.05 | 0.05 | | 0.05 | 0.05 | 0.05 | 0.05 | 0.05 | 0.05 | 0.05 | 0.05 | 0.05 | 0.05 |
| | Thiadiazole derivative | | | 0.05 | | | | | | | | | | |
| Component (A) | Calcium sulfonate, Mineral oil, R = $C_{10-24}$ mono-, di-, tri-, | 0.1 | 0.1 | 0.1 | 0.1 | 0.1 | 0.1 | 0.1 | 0.1 | 0.1 | 0.1 | 0.1 | 0.1 | |
| | Synthetic oil R = $C_{16}H_{33}$ | | | | | | | | | | | | | 0.1 |
| | Calcium salicylate, Mineral oil, mono-, | | | | | | | | | | | | | |
| | Sulfided calcium salicylate R = $C_{10-24}$ | | | | | | | | | | | | | |
| | Calcium phenate | | | | | | | | | | | | | |
| | Magnesium sulfonate | | | | | | | | | | | | | |
| | Barium sulfonate | | | | | | | | | | | | | |
| Component (B) | Polyamide A1 | | | | | | | | | | | | | |
| | A2 | 0.3 | 0.3 | 0.3 | 0.3 | 0.3 | 0.3 | 0.3 | 0.3 | 0.3 | 0.3 | 0.3 | 0.3 | 0.3 |
| Component (C) | Acidic phosphate ester R = $C_8H_{17}$ mono-, | 0.3 | 0.3 | 0.3 | | | | | | 0.1 | 0.05 | 0.05 | 1.0 | 0.3 |
| | di- | | | | | | | | 0.3 | | 0.05 | | | |
| | Acidic phosphite ester R = $C_4H_6$ mono-, | | | | 0.3 | | | | | 0.1 | 0.05 | | | |
| | di-, | | | | | 0.3 | | | | | 0.05 | | | |
| | R = mono-, | | | | | | 0.3 | | | 0.1 | 0.05 | | | |

TABLE 1-continued

| | | EXAMPLES | | | | | | | | | | | | |
|---|---|---|---|---|---|---|---|---|---|---|---|---|---|---|
| | | 1 | 2 | 3 | 4 | 5 | 6 | 7 | 8 | 9 | 10 | 11 | 12 | 13 |
| | $C_{10}H_{35}$ di-, | | | | | | | 0.3 | | | 0.05 | | | |
| Antiwear agent (Friction modifier) | Tributyl phosphite | | | | | | | | | | | | | |
| | Trioctyl phosphate | | | | | | | | | | | | | |
| | Tricresyl phosphate | | | | | | | | | | | | | |
| | Zinc dialkyl dithiophosphate of long chain | | | | | | | | | | | | | |
| Transmission torque capacity | SAE No. 2 friction tester $\mu$s @100c/c | 0.131 | 0.128 | 0.132 | 0.132 | 0.133 | 0.128 | 0.127 | 0.132 | 0.130 | 0.129 | 0.120 | 0.135 | 0.130 |
| Anti-shudder property | Initial, $\mu_H/\mu_t$ New oil | 1.04 | 1.03 | 1.04 | 1.02 | 1.03 | 1.04 | 1.05 | 1.03 | 1.04 | 1.05 | 1.08 | 1.03 | 1.03 |
| | Durability, $\mu_H/\mu_t$ Durability-tested oil | 1.02 | 1.03 | 1.03 | 1.03 | 1.04 | 1.03 | 1.03 | 1.03 | 1.04 | 1.04 | 1.03 | 1.05 | 1.02 |
| Property of preventing clogging by the friction material | Oil penetration time (second) with the friction material Tested for 10,000 cycles by an SAE No. 2 friction tester | 69 | 63 | 65 | 49 | 45 | 103 | 96 | 72 | 53 | 64 | 185 | 32 | 72 |

TABLE 2

| | | EXAMPLES | | | | | | | | | | | |
|---|---|---|---|---|---|---|---|---|---|---|---|---|---|
| | | 14 | 15 | 16 | 17 | 18 | 19 | 20 | 21 | 22 | 23 | 24 | 25 |
| Base oil | Solvent-refined paraffinic mineral oil, Synthetic oil | 89.65 | 89.65 | 89.65 | 89.65 | 89.65 | 89.65 | 89.65 | 89.70 | 88.75 | 89.65 | 88.95 | 86.95 |
| Viscosity index improver | Polymethacrylate | 5.0 | 5.0 | 5.0 | 5.0 | 5.0 | 5.0 | 5.0 | 5.0 | 5.0 | 5.0 | 5.0 | 5.0 |
| Ashless dispersant | Succinimide | 4.0 | 4.0 | 4.0 | 4.0 | 4.0 | 4.0 | 4.0 | 4.0 | 4.0 | 4.0 | 4.0 | 4.0 |
| Oxidation inhibitor | Alkylated diphenyl amine | 0.3 | 0.3 | 0.3 | 0.3 | 0.3 | 0.3 | 0.3 | 0.3 | 0.3 | 0.3 | 0.3 | 0.3 |
| | 2,6-ditertiary butyl phenol | 0.3 | 0.3 | 0.3 | 0.3 | 0.3 | 0.3 | 0.3 | 0.3 | 0.3 | 0.3 | 0.3 | 0.3 |
| Metal deactivator | Benzotriazole, Thiadiazole derivative | 0.05 | 0.05 | 0.05 | 0.05 | 0.05 | 0.05 | 0.05 | 0.05 | 0.05 | 0.05 | 0.05 | 0.05 |
| Component (A) | Calcium sulfonate, Mineral oil, R = $C_{10-24}$ mono-, di-, tri- | 0.1 | | | | | | | 0.05 | 1.0 | 0.1 | 0.1 | 0.1 |
| | Synthetic oil R = $C_{16}H_{33}$ | | 0.1 | | | | | | | | | | |
| | Calcium salicylate, Mineral oil, mono-, | | | 0.1 | | | | | | | | | |
| | Sulfided calcium salicylate R = $C_{10-24}$ | | | | 0.1 | | | | | | | | |
| | Calcium phenate | | | | | 0.1 | | | | | | | |
| | Magnesium sulfonate | | | | | | 0.1 | | | | | | |
| | Barium sulfonate | | | | | | | 0.1 | | | | | |
| Component (B) | Polyamide A1 | | | | | | | | | | | 0.3 | |
| | A2 | 0.3 | 0.3 | 0.3 | 0.3 | 0.3 | 0.3 | 0.3 | 0.3 | 0.3 | | 1.0 | 3.0 |
| Component (C) | Acidic phosphate ester R = $C_8H_{17}$ mono-, di- | 0.3 | 0.3 | 0.3 | 0.3 | 0.3 | 0.3 | 0.3 | 0.3 | 0.3 | 0.3 | 0.3 | 0.3 |
| | Acidic phosphite ester R = $C_4H_6$ mono-, di-, | | | | | | | | | | | | |
| | R = $C_{10}H_{35}$ mono-, di-, | | | | | | | | | | | | |
| Antiwear agent (Friction modifier) | Tributyl phosphite | | | | | | | | | | | | |
| | Trioctyl phosphate | | | | | | | | | | | | |
| | Tricresyl phosphate | | | | | | | | | | | | |
| | Zinc dialkyl dithiophosphate of long chain | | | | | | | | | | | | |
| Transmission torque capacity | SAE No. 2 friction tester $\mu$s @100c/c | 0.129 | 0.127 | 0.120 | 0.122 | 0.134 | 0.133 | 0.130 | 0.128 | 0.135 | 0.125 | 0.115 | 0.103 |
| Anti-shudder property | Initial, $\mu_H/\mu_t$ New oil | 1.04 | 1.06 | 1.06 | 1.06 | 1.01 | 1.02 | 1.04 | 1.01 | 1.05 | 1.06 | 1.10 | 1.16 |
| | Durability, $\mu_H/\mu_t$ Durability-tested oil | 1.03 | 1.06 | 1.07 | 1.06 | 1.03 | 1.02 | 1.03 | 1.04 | 1.03 | 1.05 | 1.09 | 1.15 |
| Property of preventing clogging by the friction material | Oil penetration time (second) with the friction material Tested for 10,000 cycles by an SAE No. 2 friction tester | 63 | 58 | 68 | 62 | 72 | 85 | 88 | 63 | 172 | 66 | 69 | 82 |

The lubricant composition of the present invention for automatic transmissions contains specified concentrations of the components (A), (B) and (C) added to the lubricant base oil, showing high anti-shudder property when the lock-up mechanism is in service at a low speed for the automatic transmission equipped with a slip-controlled mechanism, high durability to work for an extended period without being degraded, high property of preventing clogging of the friction material for an extended period, and sufficient transmission torque capacity.

We claim:

1. A lubricant composition, comprising a lubricant base oil and the following components (A), (B) and (C):

component (A):

at least one compound selected from the group consisting of the following general formulae [I] through [VII];

[I]

(1)

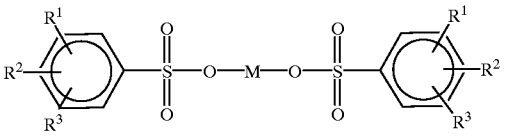

[II]

(2)

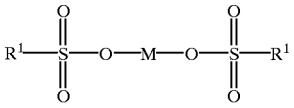

[III]

(3)

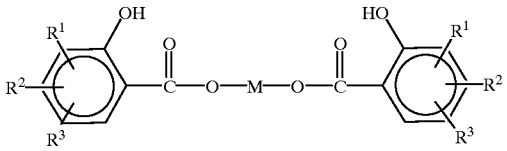

[IV]

(4)

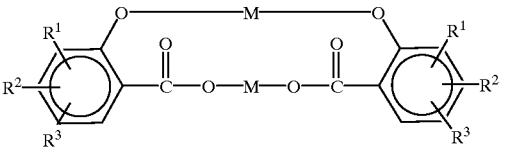

[V]

(5)

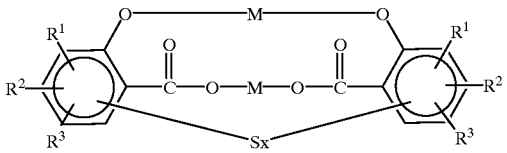

[VI]

(6)

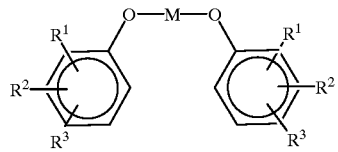

and

-continued

[VII]

(7)

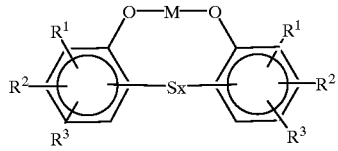

wherein, M is an alkaline-earth metal, $R^1$ is a hydrocarbon group having a carbon number of 6 to 18, and $R^2$ and $R^3$ are independently hydrogen or a hydrocarbon group having a carbon number of 1 to 18, which may be the same or different from each other in the general formulae [I] through [VII], and x is an integer of 1 to 5 in the general formulae [V] and [VII], component (B):

a polyamide compound represented by the following general formula

[VIII]

(8)

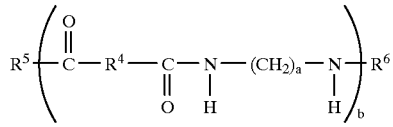

wherein, $R^4$ is a hydrocarbon group having a carbon number of 12 to 50, $R^5$ is an OH group or a $H_2N(CH_2)_cNH$ group, $R^6$ is hydrogen or a HOOC-$R^7$-CO group, a is an integer of 2 to 6, b is an integer of 1 to 10, c in the above formula $H_2N(CH_2)_cNH$ is an integer of 2 to 6, and $R^7$ in the formula HOOC-$R^7$-CO is a hydrocarbon group having a carbon number of 12 to 50, and component (C):

at least one compound selected from the group consisting of acid phosphate esters and acid phosphite esters, concentrations of components (A), (B) and (C) in the total lubricant composition being (A) 0.05 to 2%, (B) 0.15 to 4% and (C) 0.05 to 1.5%, all by weight.

2. The lubricant composition of claim 1 wherein said component (B) is a polyamide compound represented by the general formula [IX],

[IX]

(9)

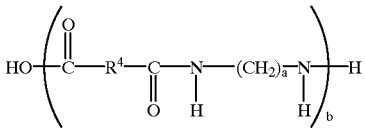

wherein, $R^4$ is a hydrocarbon group having a carbon number of 12 to 50, a is an integer of 2 to 6 and b is an integer of 1 to 10.

3. The lubricant composition of claim I wherein said component (B) is a polyamide compound represented by the general formula [X],

[X]

(10) 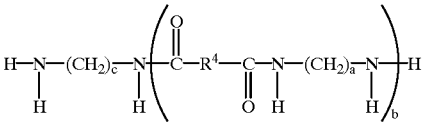

wherein, $R^4$ is a hydrocarbon group having a carbon number of 12 to 50, a is an integer of 2 to 6, b is an integer of 1 to 10 and c is an integer of 2 to 6.

4. The lubricant composition of claim 1, 2 or 3 wherein said component (A) is at least one compound selected from the group consisting of the general formulae [I] through [VII], wherein $R^1$ is an alkyl or alkenyl group having a carbon number of 6 to 18, and $R^2$ and $R^3$ are independently hydrogen, or an alkyl or alkenyl group having a carbon number of 1 to 5, which may be the same or different from each other.

5. The lubricant composition of claim 1, 2 or 3 wherein said component (C) is an acid phosphate ester.

6. The lubricant composition of claim 1, 2 or 3 wherein said component (C) is an acid phosphite ester.

7. The lubricant composition of claim 1, 2 or 3 wherein said component (C) is a mixture of an acid phosphate ester and an acid phosphite ester.

8. A method of making a lubricant composition, comprising obtaining a lubricant base oil and adding to the lubricant base oil the following components (A), (B) and (C):

component (A):

at least one compound selected from the group consisting of the following general formulae [I] through [VII]:

[I]

(1) 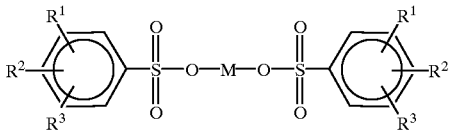

[II]

(2) 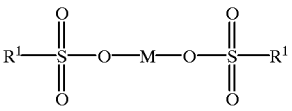

[III]

(3) 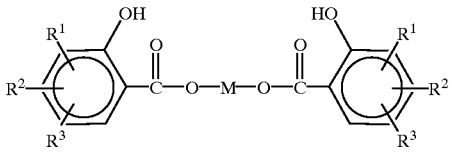

[IV]

(4) 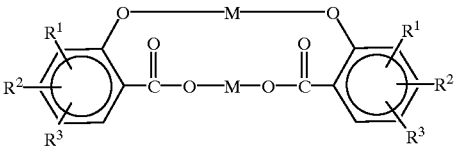

-continued

[V]

(5) 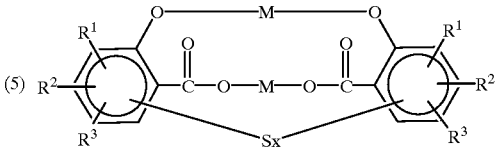

[VI]

(6) 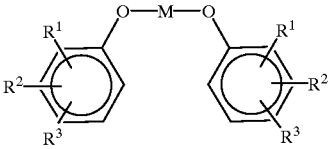 and

[VII]

(7) 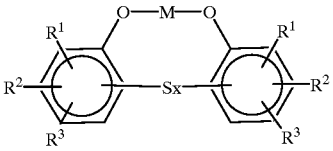

wherein, M is an alkaline-earth metal, $R^1$ is a hydrocarbon group having a carbon number of 6 to 18, and $R^2$ and $R^3$ are independently hydrogen or a hydrocarbon group having a carbon number of 1 to 18, which may be the same or different from each other in the general formulae [I] through [VII], and x is an integer of 1 to 5 in the general formulae [V] and [VII], component (B):

a polyamide compound represented by the following general formula [VIII]:

[VIII]

(8) 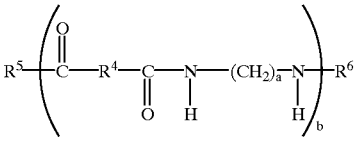

wherein $R^4$ is a hydrocarbon group having a carbon number of 12 to 50, $R^5$ is an OH group or a $H_2N(CH_2)_cNH$ group, $R^6$ is hydrogen or a HOOC-$R^7$-CO group, a is an integer of 2 to 6, b is an integer of 1 to 10, c in the above formula $H_2N(CH_2)_cNH$ is an integer of 2 to 6, and $R^7$ in the formula HOOC-$R^7$-CO is a hydrocarbon group having a carbon number of 12 to 50, and component (C):

at least one compound selected from the group consisting of acid phosphate esters and acid phophite esters, wherein 0.05 to 2% of the weight of the total lubricant composition is from the addition of component (A); 0.15 to 4% of the weight of the total lubricant composition is from the addition of component (B); and 0.05 to 1.5% of the weight of the total lubricant composition is from the addition of component (C).

9. The method of claim 8 wherein said component (B) is a polyamide compound represented by the general formula [IX],

[IX]

(9) 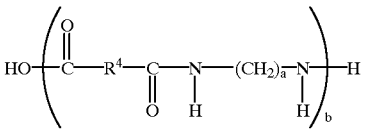

wherein $R^4$ is a hydrocarbon group having a carbon number of 12 to 50, a is an integer of 2 to 6 and b is an integer of 1 to 10.

10. The method of claim 8 wherein said component (B) is a polyamide compound represented by the general formula [X],

[X]

(10) 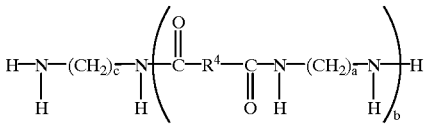

wherein $R^4$ is a hydrocarbon group having a carbon number of 12 to 50, a is an integer of 2 to 6, b is an integer of 1 to 10 and c is an integer of 2 to 6.

11. The method of claim 8, 9 or 10 wherein said component (A) is at least one compound selected from the group consisting of the general formulae [I] through [VII], wherein $R^1$ is an alkyl or alkenyl group having a carbon number of 6 to 18, and $R^2$ and $R^3$ are independently hydrogen, or an alkyl or alkenyl group having a carbon number of 1 to 5, which may be the same or different from each other.

12. The method of claim 8, 9 or 10 wherein said component (C) is an acid phoshate ester.

13. The method of claim 8, 9 or 10 wherein said component (C) is an acid phosphite ester.

14. The method of claim 8, 9 or 10 wherein said component (C) is a mixture of an acid phosphate ester and an acid phosphite ester.

* * * * *